US006042226A

United States Patent [19]

Therien

[11] Patent Number: 6,042,226

[45] Date of Patent: Mar. 28, 2000

[54] APPARATUS AND METHOD OF PRIMING INK SUPPLY TUBES IN AN INK JET PRINTER

[75] Inventor: Patrick J Therien, Battle Ground, Wash.

[73] Assignee: Hewlett-Packard Company, Palo Alto, Calif.

[21] Appl. No.: 08/814,069

[22] Filed: Mar. 10, 1997

[51] Int. Cl.[7] ..... B41J 2/19

[52] U.S. Cl. ..... 347/92

[58] Field of Search ..... 347/84, 85, 86, 347/87, 92, 30

[56] References Cited

U.S. PATENT DOCUMENTS

| | | | |
|---|---|---|---|
| 4,510,510 | 4/1985 | Terasawa | 347/30 |
| 4,628,333 | 12/1986 | Terasawa | 347/30 |
| 4,847,637 | 7/1989 | Watanabe et al. | 347/30 |
| 4,967,207 | 10/1990 | Ruder | 347/87 |
| 4,999,652 | 3/1991 | Chan | 347/86 |
| 5,185,614 | 2/1993 | Courian et al. | 347/30 |
| 5,774,154 | 6/1998 | Underwood | 347/85 |
| 5,847,734 | 12/1998 | Pawlowski | 347/86 |

FOREIGN PATENT DOCUMENTS

| | | | |
|---|---|---|---|
| 62-161544 | 7/1987 | Japan | 347/86 |
| 84/02841 | 8/1984 | WIPO | 141/18 |

*Primary Examiner*—N. Le
*Assistant Examiner*—Michael Nghiem

[57] ABSTRACT

An ink jet printer with a body with a paper path and a carriage operable to reciprocate across the paper path. The printer body has an ink supply receptacle spaced apart from the carriage, with an ink tube extending between the ink supply receptacle and the carriage. A suction apparatus is connected to the tube and generates a negative pressure in the tube relative to ambient pressure, such that ink may be sucked from the ink supply receptacle to remove at least some of the air from the tube.

18 Claims, 3 Drawing Sheets

APPARATUS AND METHOD OF PRIMING INK SUPPLY TUBES IN AN INK JET PRINTER

FIELD OF THE INVENTION

This invention relates to ink jet printers, and particularly to ink jet printers with remote ink supplies.

BACKGROUND AND SUMMARY OF THE INVENTION

A typical ink jet printer has a pen that reciprocates over a printable surface such as a sheet of paper. The includes a print head having an array of numerous orifices through which droplets of may be expelled onto the surface to generate a desired pattern. Some ink jet printers have a replaceable ink supply mounted to a stationary position on the printer, and connected to a reciprocating print head by a conduit. This permits the use of a larger ink supply, and avoids the need to replace the print head each time the supply of ink is depleted. Color ink jet printers generally have a multi-chamber cartridge, or several ink supply cartridges each containing a different color of ink.

Printers with remote ink supplies are normally shipped with the ink supplies and print head removed, or in a "dry" condition. This avoids potential leakage of the ink and shelf life reduction that begins when the tubes are filled with ink. If ink were to remain in the ink conduit for an extended period between manufacturing and first use, air may be absorbed by the ink, and water evaporated, undesirably changing the consistency of the ink outside of normal parameters. In addition, the print head may be protected in special packaging against potential shocks during shipping. When printers are shipped "dry," the ink conduits are empty, except for the presence of ambient air.

When setting up such a printer for its first use, as ink flows from the ink supply to the print head and its on-board reservoir, the air volume within the ink tube is forced into the print head reservoir. If the reservoir is sufficiently large, this can be readily accommodated, but leaves a substantial air volume in the reservoir. Thereafter, ambient pressure or temperature variations, such as caused by changing weather or air travel, can generate pressure changes in the air bubble that undesirably force ink from the orifice. The consequences of such leakage include user inconvenience, printer damage, and impaired printing.

These disadvantages may be avoided or reduced by providing an ink jet printer with a body having a paper path, and a carriage operable to reciprocate across the paper path. The printer body has an ink supply receptacle spaced apart from the carriage, with an ink tube extending between the ink supply receptacle and the carriage. A suction apparatus is connected to the tube and generates a negative pressure in the tube relative to ambient pressure, such that ink may be sucked from the ink supply receptacle to remove at least some of the air from the tube.

DETAILED DESCRIPTION OF A PREFERRED EMBODIMENT

Figure 1:
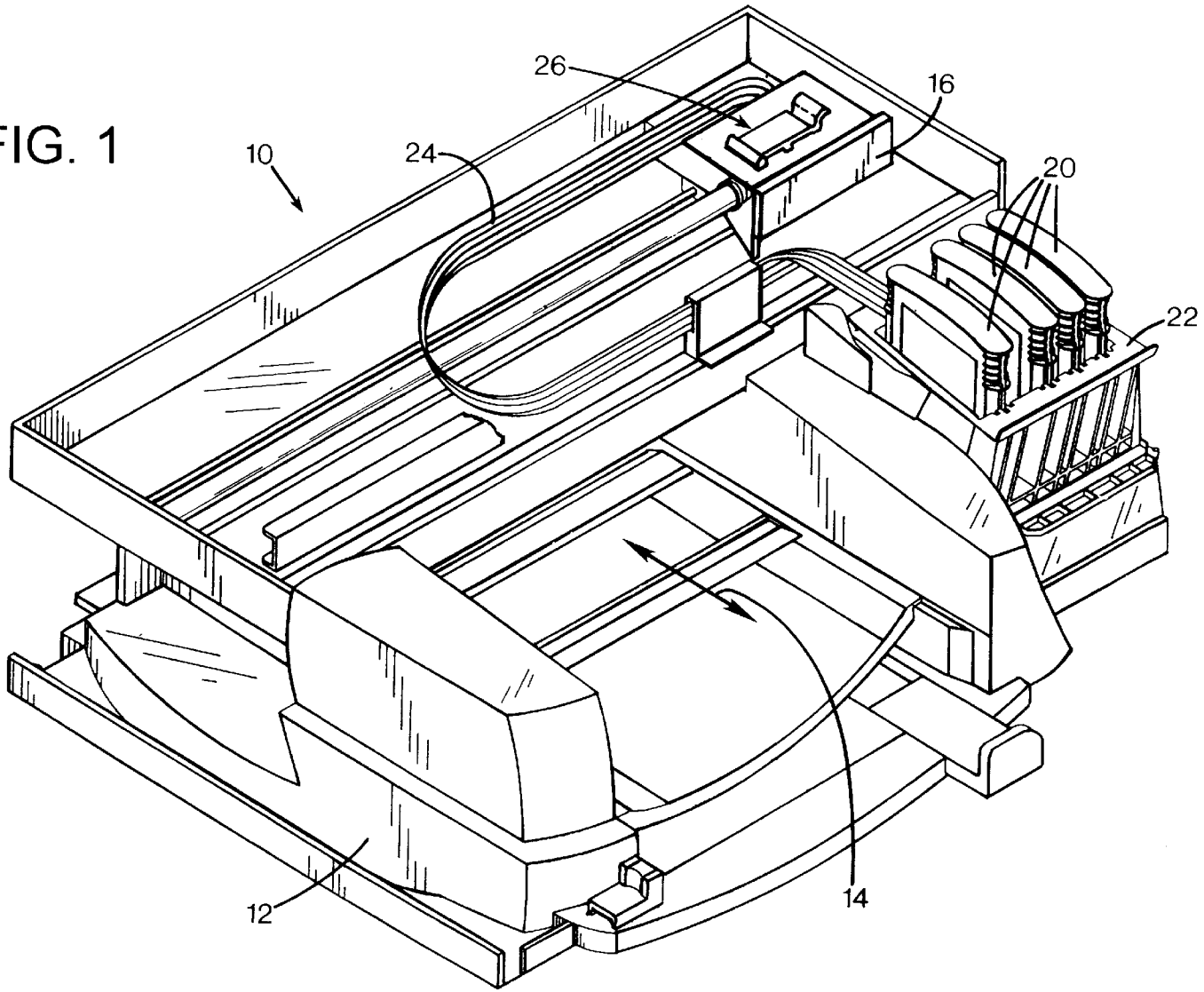
FIG. 1 is a perspective view of a printer according to a preferred embodiment of the invention.

FIG. 1 shows an ink jet printer 10 having a housing 12. A paper path 14 runs through the housing, below a reciprocating carriage assembly 16. Four or more ink supply cartridges 20, each of a different color, are received in a stationary ink supply receptacle 22 defined in the housing. A flexible ink supply tube 24 defining four conduit passages, each connected to a respective one of the ink cartridges, extends in an arc to the carriage 16, and to a suction cartridge 26 connected to the carriage. As illustrated, the printer has been recently shipped, and the ink cartridge installed to prepare the printer for its first use.

Figure 2:
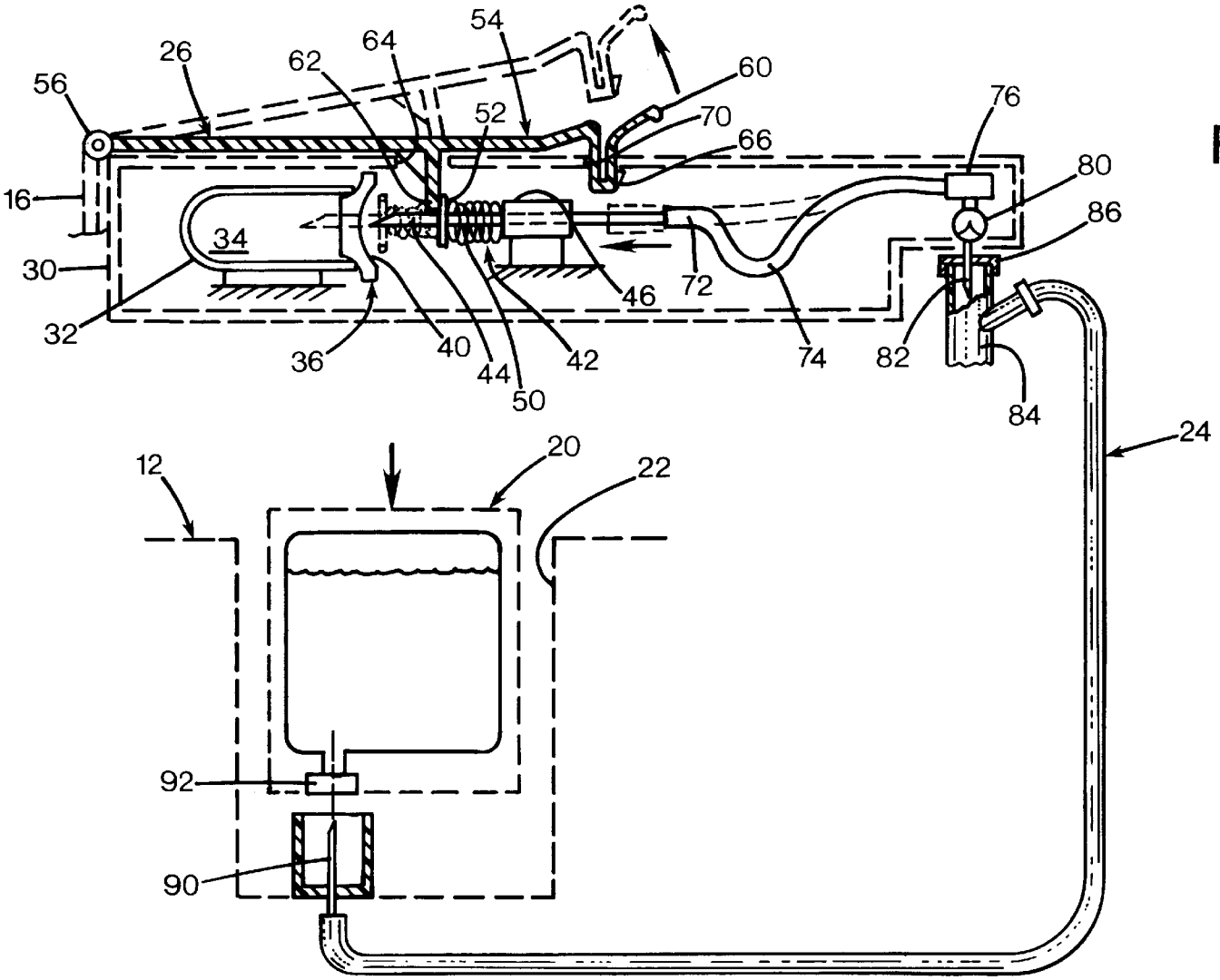
FIG. 2 is a schematic sectional view of an ink evacuation system according to the embodiment of FIG. 1.

FIG. 2 shows the interior detail of the suction apparatus 26, along with its connection to an ink supply cartridge 20 via the ink tube 24. In this illustration, the suction apparatus is shown for simplicity as connected to only one of the four ink supplies, although the single suction apparatus is connected to all four supplies as will be shown below with respect to FIG. 3. The suction device includes a housing 30 having a shape that is readily received by the carriage in the same position as the ink jet print heads (not shown) that will replace it after printer setup; the suction apparatus also connects to the printer's ink plumbing system in the same manner as the print head.

Connected to the housing 30, a sealed enclosure 32 defining a chamber 34 is evacuated to sustain a vacuum. For the purposes of this embodiment, a "vacuum" may be a partial vacuum at lower pressure than any ambient pressure to which the printer is likely to be subject, although near vacuum is preferred to permit miniaturization of components. In the preferred embodiment, the enclosure is a glass test tube with a rubber stopper 36 having a thin central septum 40, similar to conventional test tubes used for drawing blood for medical purposes. In alternative embodiments, the enclosure may be metal or any suitable material.

A spring loaded needle assembly 42 is connected within the housing adjacent the septum 40. A hollow needle 44 has a sharp point directed toward the septum, and reciprocates toward and away from the septum within a sleeve 46 mounted to the housing. A compression spring 50 surrounds the needle, and is captured between the sleeve and a needle shoulder 52 at an intermediate position on the needle. The needle is movable between a retracted position (shown in solid lines) in which the spring is compressed, and an extended position (shown in dashed lines) in which the spring is extended and in which the needle point penetrates the septum 40 to provide fluid communication between the chamber 34 and the hollow bore of the needle. The septum has sufficient thickness that it seals about the penetrating needle to prevent leakage of ambient air into the chamber.

A pivoting latch 54 is pivotally mounted to the carriage 16, and is movable between a restraining position (shown in solid lines) and a releasing position (shown in dashed lines). The latch has a flat elongated body parallel to and resting just above the upper surface of the housing 30 when in the restraining position. The latch body has a hinge end 56 and a free end 60. As an alternative to the hinged latch, the latch may be removable from the printer. A pawl 62 extends laterally and perpendicularly from an intermediate point on the body, through a first aperture 64 in the body, and proximate the needle 44 between the shoulder 52 and the needle point. Thus, the shoulder is restrained by the pawl when the latch is in the restraining position, preserving the vacuum in the chamber 34 by maintaining the needle in the retracted position. To prevent the latch from releasing the needle unintentionally, the end of the latch includes a flexible spring portion 66 extending into a second aperture 70 in the housing 30, and having a tooth that prevents the latch from being disengaged unless the spring portion is flexed to permit the tooth top to clear the housing. Alternatively, an over center spring biased latch or lever would also prevent unwanted disengagement by small forces.

A second end 72 of the needle 44 extends clear of the sleeve 46 in all positions in its range of motion, and is connected to a flexible tube 74 extending to a manifold 76. The tube 74 has sufficient slack length when the needle is in the retracted position to permit the needle to reach the extended position without generating tension in the tube. The manifold communicates with a duck bill-type check valve 80 for each of the ink color lines with which it communicates. Each check valve is oriented such that it permits fluid flow only from the ink supply toward the vacuum chamber, and prevents ink of mixed color in the manifold from returning to the separate ink supplies.

A second needle 82 rigidly mounted to the housing 30 extends downward from the housing toward a fluid interconnect or ink tube terminal 84 on the printer carriage, having a septum 86 facing the needle 82, and connected with one tube 24 of the ink supply conduit. At the opposite end of the tube 24, the tube is connected to a third needle 90 at the printer ink supply station that protrudes upwardly to penetrate a septum 92 of one of the ink supply cartridges 20, which is shown partially installed in the ink supply receptacle 22 of the printer housing 12.

Figure 3:
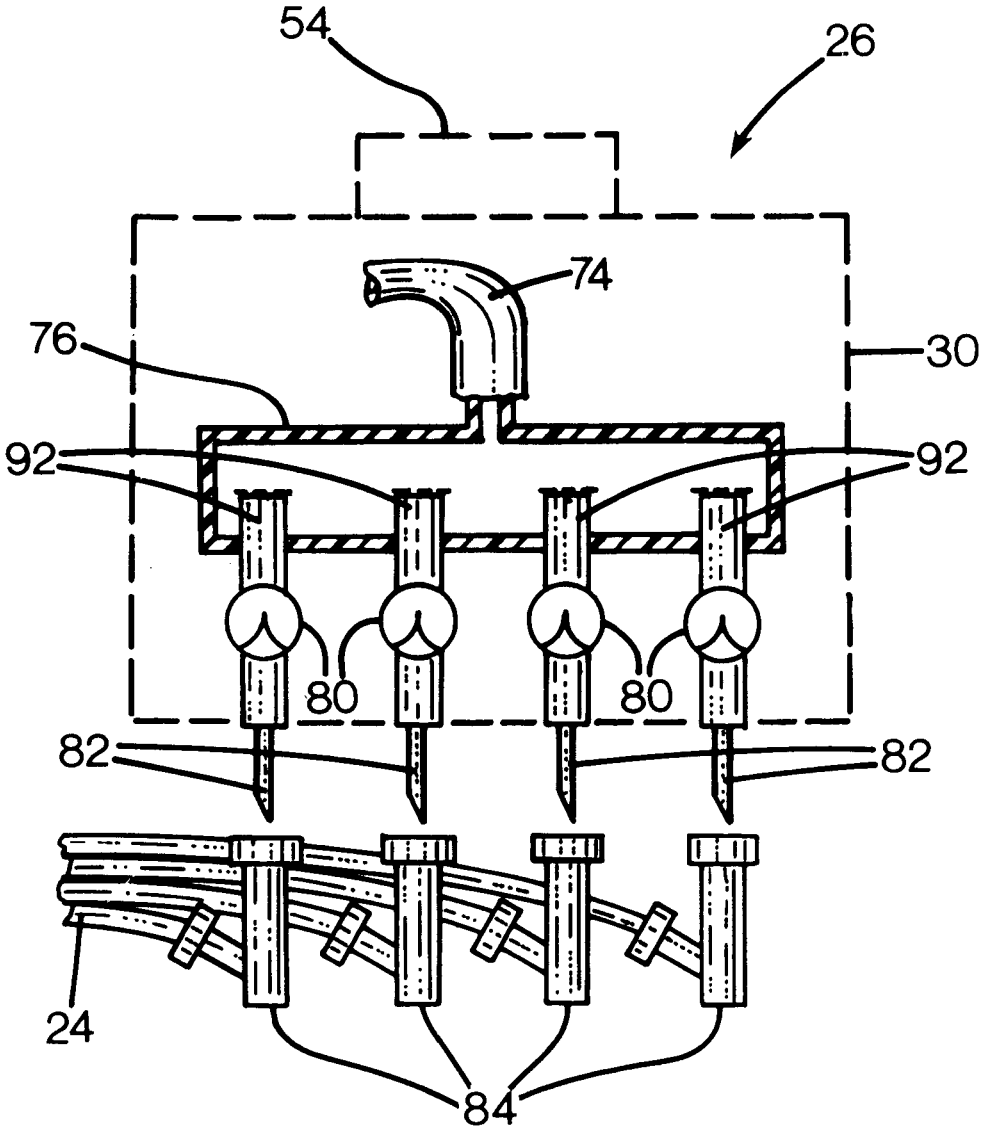
FIG. 3 is a schematic side view of the embodiment of FIG. 1.

FIG. 3 shows an end view of the suction apparatus 26 positioned above an array of four ink tube terminals 84 to which each of the needles 82 is normally connected. The manifold 76 has four separate inlets, with the check valves 80 each associated with a single inlet "upstream" of the manifold. Within the manifold, four optional standpipes 92, each associated with a single inlet, are topped with a fine mesh screen that admits air when dry, but which resists the passage of liquid. These act as a further precaution against cross contamination of ink in the ink terminals 84 that might not entirely be prevented by the check valves 80, and to reduce nonproductive ink consumption by the evacuation or priming process. Such might occur if the ink tubes have different flow resistance characteristics whereby some tube are entirely primed with ink before others. Instead of further drawing ink from the first of the tubes that filled, the mesh permits the remaining suction action to work entirely on the remaining tubes, and prevents or reduces the ink from the first tubes from filling the manifold and wetting the other mesh screens.

In an alternative embodiment, the volume of the vacuum chamber may be established to draw ink to fill a major fraction, such as 90% of each tube. Thus, there would be no need for valves and screens, as the ink would not reach the manifold. Although some air may flow into the print head reservoir, this amount would be reduced to acceptable levels.

OPERATION

The priming process begins with the shipment and delivery of a printer with empty, air-filled ink tubes 24, with a suction apparatus 26 installed in the carriage and in communication with the ink terminals 84, with ink supply cartridges 20 packaged separately and not installed, and with the carriage positioned in a position inaccessible to the user.

The user removes the printer from its packaging, and connects it to a power source. The carriage remains inaccessible until the user installs all the ink supply cartridges. When the printer senses that all cartridges are installed, the carriage moves from the inaccessible service area behind the cartridges to an accessible area over the paper path. The user then lifts the latch to permit the needle 44 to penetrate the septum 40, and the ink is drawn through the tubes 24. As an alternative to lifting the hinged latch, in the alternative embodiment with a removable latch, the latch is entirely removed from the printer. This generally requires a very brief time to fully prime the tubes. To reduce potential confusion, the latch may have a legend such as "lift first," and may reveal a second legend on the suction cartridge reading "wait to remove until prompted." After a sufficient time internal, the printer prompts the user that the suction cartridge may be removed from the carriage, and replaced with a print head that was packaged with the printer. The user then removes the cartridge from the carriage and installs the print head, which has a similar exterior profile as the suction cartridge, an which has a similar four-needle interface for connecting to the ink terminals 84. Thus, the cartridge is replaced by the print head. In alternative embodiments, four separately replaceable print heads may be provided, each with its own connection to the ink supply.

In the preferred embodiment, which is a printer for printing letter and legal size documents, the ink tubes each have a length of 800 mm and an interior diameter of 1.3 mm for an individual tube volume of 1.06 ml per tube total tube volume of 4.25 ml (plus the volume of the ink terminals and manifold). The vacuum chamber must have a greater volume than this to fully prime the tubes, or at least a major fraction of this to substantially reduce the air volume accumulated in the pen reservoirs. Preferably, the vacuum chamber has sufficiently greater volume to account for any partiality of the original vacuum, to account for the volume of the ink terminals and tubing in the suction cartridge, and to ensure that there is sufficient suction capacity remaining for the slowest tube to fill. Because the air in the tubing system will diminish the pressure differential as priming proceeds, the rate of suction will slow through the priming process. Thus, to avoid an undesirable slow priming process, with the risk that a user will remove the suction cartridge before priming is completed, extra vacuum chamber volume is required. In the preferred embodiment, the vacuum chamber has a volume of about 1–5 times the volume of the tubing to be filled with ink.

While the invention is described in terms of preferred an alternative embodiments, the following claims are not intended to be so limited. For example, the vacuum chamber may be movable relative to a stationary needle, the spring may be eliminated and user-applied force and motion used to penetrate the chamber, and the ink supplies may include an unpigmented fixer or coating to provide water resistance of the printed output, or a photographic appearance.

I claim:

1. An ink jet printer comprising:

a body having a first portion defining a paper path;

a carriage connected to the body for reciprocation across the paper path;

the body having a second portion defining an ink supply receptacle for receiving a supply of ink, the receptacle being spaced apart from the carriage;

an air-filled ink tube extending between the ink supply receptacle and the carriage;

a gas suction apparatus on the carriage, connected to the tube and operable to generate a negative gas pressure in the tube relative to ambient pressure, such that in response to the presence of a supply of ink to the ink supply receptacle, ink is sucked from the ink supply receptacle to remove at least some of a supply of air from the tube, and wherein the carriage includes a first portion which defines a print head receptacle, and the suction apparatus is removably received in the print head receptacle.

2. The ink jet printer of claim 1 wherein the suction apparatus includes a first portion which defines a low pressure chamber containing a partial vacuum with respect to ambient air pressure.

3. The ink jet printer of claim 2 including vacuum connection means for providing fluid communication between the tube and the chamber.

4. The ink jet printer of claim 3 wherein the connection means comprises a hollow needle and a septum.

5. The ink jet printer of claim 4 wherein the needle is connected to the tube, and wherein the septum defines a portion of the chamber.

6. The ink jet printer of claim 5 wherein the needle and septum are separate, biased toward each other, and wherein the suction apparatus includes a restraint element contacting at least one of the needle and septum, such that penetrative contact of the septum by the needle is prevented.

7. The ink jet printer of claim 6 wherein the restraint element is removable from the printer.

8. The ink jet printer of claim 1 wherein the tube defines a plurality of independent tube passages, each of the plurality of independent tube passages for a different color ink, and including a plurality of check valves, each of the plurality of check valves connected to one of the tube passages, each check valve permitting fluid flow only toward the suction apparatus, such that ink from a first one of the tube passages does not enter the suction apparatus and return to contaminate another second one of the tube passages.

9. The ink jet printer of claim 1 wherein the suction apparatus is selectably disconnectable from communication with the tube.

10. A method of preparing an ink jet printer for operation comprising the steps:

providing a printer having an ink supply and a carriage connected by an air-filled ink tube having a first end connected to the ink supply and a second end connected to the carriage;

connecting a supply of ink to the ink supply;

generating gas suction on the second end of the ink tube to draw air out from within the tube; and wherein the step of generating suction includes connecting the ink tube to a gas suction device operable to generate a partial gas vacuum, and including the step of replacing the gas suction device with a print lead.

11. The method of claim 10 wherein the step of generating suction includes providing a suction device defining a chamber having a lower gas pressure than ambient pressure, and connecting the ink tube to the chamber.

12. The method of claim 10 wherein the step of generating suction includes connecting the ink tube to a suction device defining a chamber containing a partial vacuum.

13. The method of claim 12 wherein the step of connecting the ink tube to the chamber includes penetrating a portion of the suction device with a hollow needle connected to the tube.

14. The method of claim 13 including the step of restraining the needle apart from the suction device before connecting the ink tube to the suction device, and wherein the step of connecting the ink tube to the suction device includes the step of biasing the needle toward the suction device, and the step of stopping the restraining to allow the needle to penetrate the suction device.

15. The method of claim 14 including the step of providing a restraint connected to at least one of the needle and the suction device, and wherein generating suction includes the step of entirely removing the restraint from the printer.

16. The method of claim 12 including the step of removing the suction device from the printer carriage after connecting the ink tube to the suction device.

17. The method of claim 10 wherein the step of generating suction includes generating suction at a portion of the ink tube adjacent to the carriage, and substantially filling the entire tube with ink.

18. An ink jet priming apparatus comprising:

a housing;

a fluid connector connected to the housing;

a sealed chamber connected to the housing and containing at least a partial vacuum;

a connection mechanism connected to the housing for selectably providing fluid communication between the fluid connector and chamber, such that the chamber generates suction at the fluid connector to draw ink toward the connector; and wherein the housing includes a first portion which defines a print head receptacle, and the sealed chamber is removably received in the print head receptacle.

* * * * *

UNITED STATES PATENT AND TRADEMARK OFFICE

CERTIFICATE OF CORRECTION

PATENT NO. : 6,042,226
DATED : March 28, 2000
INVENTOR(S) : Therien

It is certified that error appears in the above-identified patent and that said Letters Patent is hereby corrected as shown below:

Column 1,
Line 11, after "The" insert -- pen --.

Column 3,
Line 41, delete "tube" and insert therefor -- tubes --.

Column 4,
Line 15, delete "an" and insert therefor -- and --.

Claims,
Column 6,
Line 2, delete "lead" and insert therefor -- head --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*